United States Patent [19]

Loeffler

[11] 4,209,866

[45] Jul. 1, 1980

[54] SWIM FIN

[75] Inventor: Herbert H. Loeffler, Arlington, Mass.

[73] Assignee: Arthur D. Little, Inc., Cambridge, Mass.

[21] Appl. No.: 947,459

[22] Filed: Oct. 2, 1978

[51] Int. Cl.[2] ..... A63B 31/10

[52] U.S. Cl. ..... 9/304; 9/309

[58] Field of Search ..... 9/301, 304, 305, 309, 9/303, 306

[56] References Cited

U.S. PATENT DOCUMENTS

| | | | |
|---|---|---|---|
| 2,343,468 | 3/1944 | Messinger | 9/304 |
| 3,055,025 | 9/1962 | Ferrard et al. | 9/309 |
| 3,082,442 | 3/1963 | Cousteau et al. | 9/309 |
| 3,183,529 | 5/1965 | Beuchat | 9/309 |
| 3,422,470 | 1/1969 | Mares | 9/309 |
| 3,665,535 | 5/1972 | Picken | 9/304 |
| 3,908,213 | 9/1975 | Hill | 9/309 |
| 4,083,071 | 4/1978 | Forjot | 9/309 |

*Primary Examiner*—Charles E. Frankfort
*Attorney, Agent, or Firm*—Bessie A. Lepper

[57] ABSTRACT

A swim fin which achieves increased efficiency by increasing drive (forward propulsive thrust) and decreasing effort (resistance to vertical motion) to provide a greater drive-to-effort ratio. The blade of the fin which is pivotally mounted to the foot section along a pivot line aft of the leading edge of the blade, has a reversible effective streamlining camber. These features in combination with a large open flow passage defined between the toe portion and blade make possible the attainment of efficient propulsion through vertical motion of the legs of the wearer of the swim fins.

6 Claims, 6 Drawing Figures

SWIM FIN

This invention relates to fins adapted to be worn on the feet of a swimmer to increase swimming efficiency.

The use of swim fins in underwater swimming such as in snorkeling or in scuba or ocean diving, is a generally utilized technique for achieving a greater propulsive effort from the swimminer's leg motion than is possible with the human foot alone. The purpose of swim fins is therefore to convert a swimmer's vertical leg motion resulting from a "flutter kick" into more effective horizontal propulsion. The resistance of the fin to vertical motion can be designated effort; and the resulting horizontal propulsive force can be considered drive. Since the efficiency of the swim fin, i.e., of its blade or foil, may be defined as the drive-to-effort ratio, it is apparent that efficiency is increased by increasing the drive, decreasing the effort or a combination of both.

In the design of the prior art swim fins the emphasis has been placed upon only one of these efficiency-controlling factors, i.e., the decreasing of effort by decreasing resistance to vertical fin motion. According to the prior art it appears that three basic approaches have been taken to decrease this resistance: providing for the pivoting of the blade along its leading edge (see for example U.S. Pat. Nos. 2,343,468 and 3,082,442); providing fixed openings in the fin blade (see for example U.S. Pat. Nos. 3,082,442, 3,183,529 and 3,908,213); and providing variable openings in the blade (see for example U.S. Pat. Nos. 3,055,025 and 3,422,470).

Although these basic approaches have contributed to and improved the efficiency of swim fins for what may be termed "light" uses, e.g., snorkeling, there remains a real need for increased efficiency in swim fins for "heavy" uses, e.g., long distance underwater swimming such as required in scuba or ocean diving. The swim fins constructed in accordance with this invention achieve increased efficiency by not only decreasing resistance but also by increasing drive. They are, of course, applicable to all types of underwater activity.

It is therefore a primary object of this invention to provide improved swim fins particularly suited to heavy uses such as long distance underwater swimming. It is another object of this invention to provide swim fins of the character described which increase the drive resulting from the swimmer's kicking without increasing his effort. It is a further object to provide swim fins for which the improved efficiency extends over the entire range of kicking force.

Other objects of the invention will in part be obvious and will in part be apparent hereinafter.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which FIG. 1 is a perspective view of a swim fin constructed in accordance with this invention;

Figure 1:
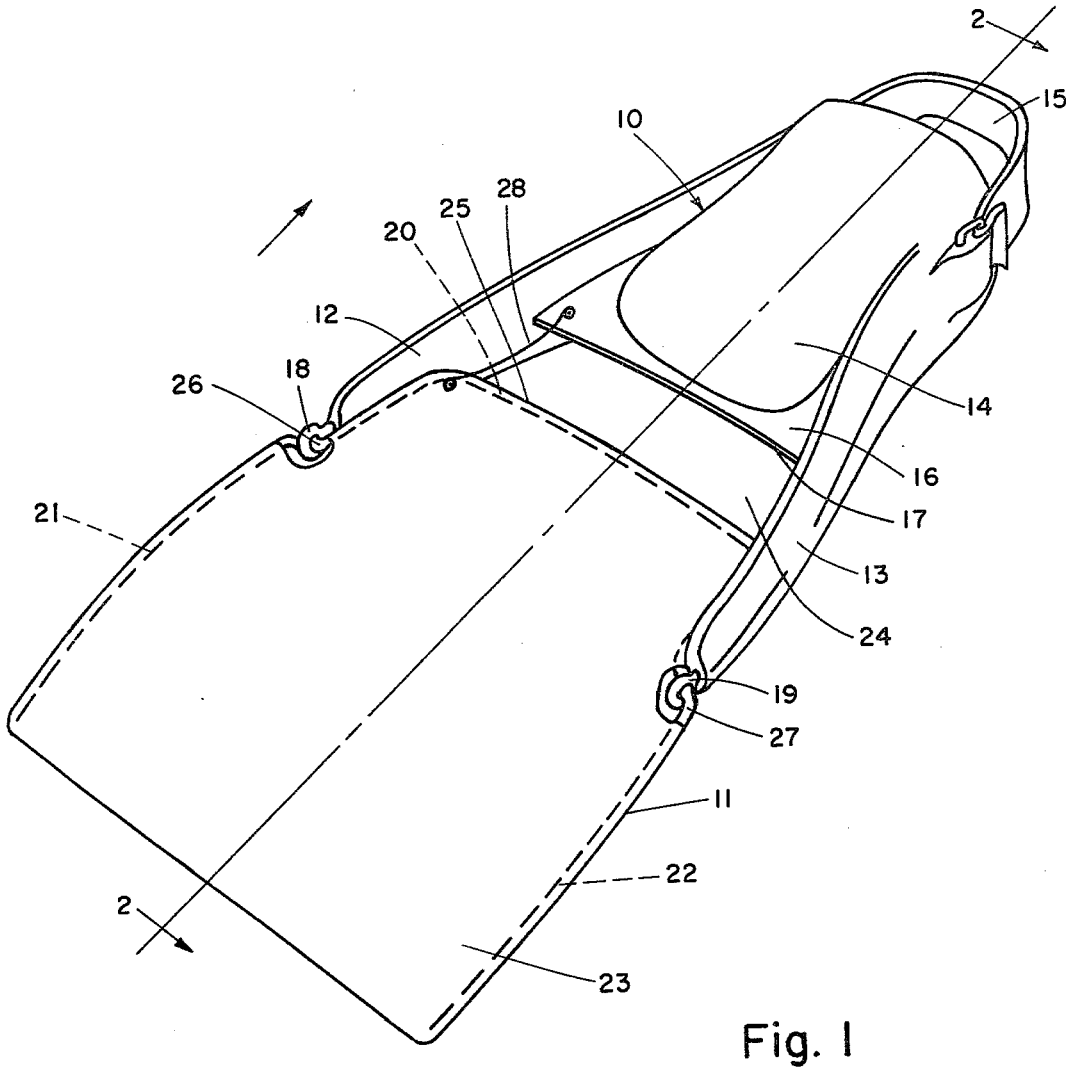
Figure 2:
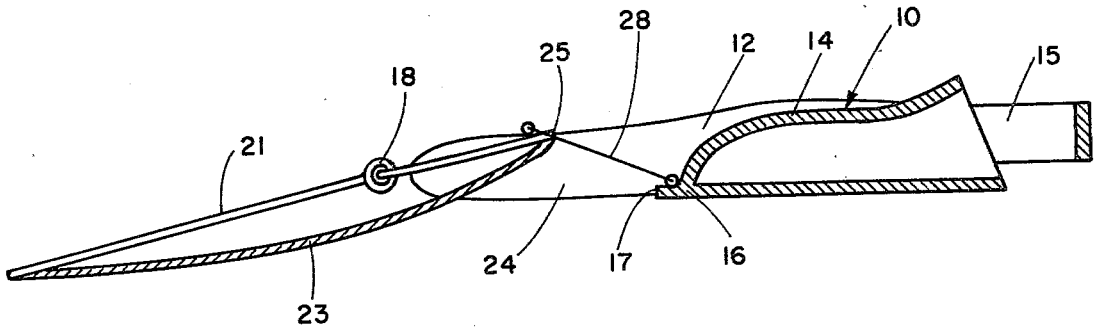
FIG. 2 is a cross section along the length of the swim fin of FIG. 1 taken through plane 2—2 of that figure.

As will be seen in FIGS. 1 and 2, the swim fin of this invention comprises a foot section, generally identified by reference number 10, a blade 11 and two rigid pivot supports members 12 and 13 affixed to or molded integrally with the foot section. Foot section 10 comprises a toe portion 14 and a heel portion 15 in the form of an adjustable-length strap. Toe portion 14 is faired into a flat extension member 16 which extends a short distance beyond the trailing or after end of toe portion 14 and out to the inner walls of pivot support members 12 and 13. Extension member 16 terminates in a foot section trailing edge 17. Pivot supports 12 and 13 extend aft of the trailing edge 17 and terminate in opposing rings 18 and 19. The terms "leading" and "trailing" edges are used in the conventional sense assuming the fin is moving forward in the direction of the arrow.

Blade 11 is formed as a rigid, preferably one-piece, frame, having a leading end section 20 and opposite side sections 21 and 22, on which a flexible membrane 23 is mounted. Blade 11 is so configured and sized as to define an open passage 24 between its leading edge 25 and trailing edge 17 of extension member 16. Blade 11 is arranged to pivot through a predetermined angle with respect to the pivot support members and this is conveniently accomplished by putting an essentially double right-angled bend in frame side sections 21 and 22 to provide exposed frame sections 26 and 27 suitable for insertion through rings 18 and 19 in the pivot supports. Inasmuch as it is necessary to limit the pivot angle of blade 11, means are provided for doing this in the form of two oppositely disposed flexible connectors 28, e.g., wires, filaments or ropes, (only one of which is shown) which connect the lading edge of blade 11 to the extension 16 of foot section 14.

The toe and heel sections and pivot supports of the swim fin are formed of a relatively rigid material, e.g., a high durometer rubber, and are preferably molded as an integral piece. The blade frame and pivot rings are formed of a rigid material such as 8-gage steel wire or the like. Flexible membrane 23 is preferably formed of a rubber.

In order to provide the desired combination of relatively low effort (resistance to vertical motion) and increased drive, the blade of the swim fin should have a relatively small camber and a pivot point aft of its leading edge. Finally, the pivot angle should be within a predetermined range. These constructions parameters are best defined with reference to FIG. 3 which is a somewhat diagrammatic representation of a side view of the swim fin wherein the same reference numerals are used as in FIGS. 1 and 2 to identify the same components.

Figure 3:
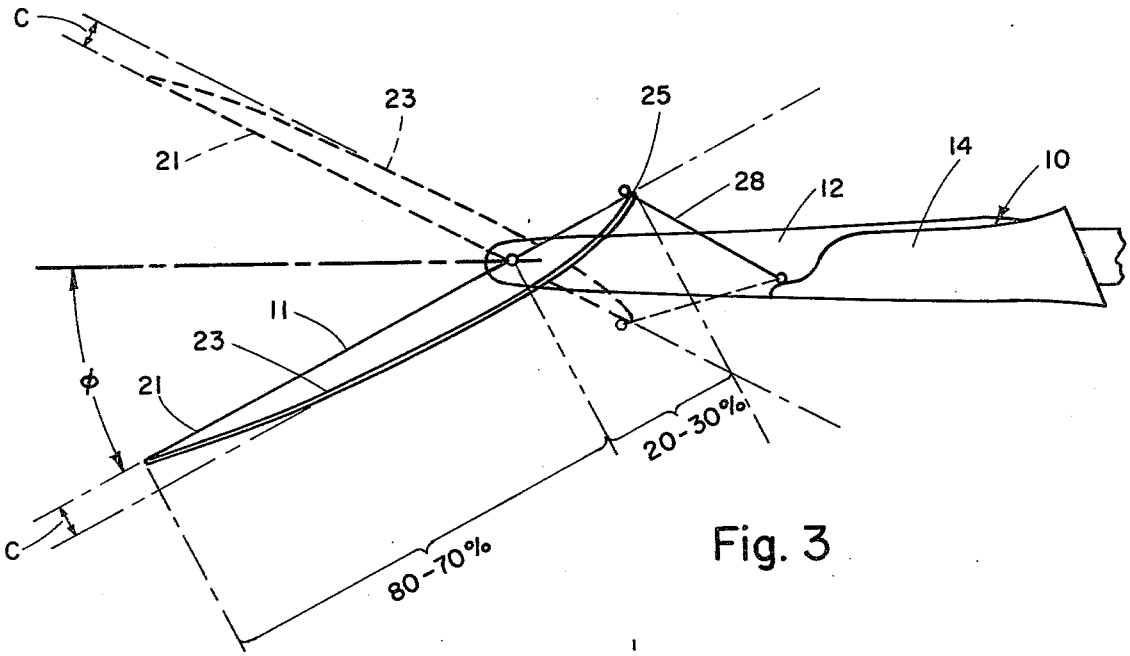
FIG. 3 is a diagrammatic representation of the swim fin of this invention illustrating the parameters which characterize its construction.

Camber may be defined as convexity or curvature of the flexible member 23 of blade 11. This blade curvature or camber is so chosen as to conform to the streamlines of water flow as it is accelerated over its surface. Camber or curvature may be specified in terms of the maximum distance flexible member 23 is moved normal to the plane of the blade frame defined by frame sections 20, 21 and 22. In FIG. 3 this distance will be seen to be designated C and in the swim fin of this invention it preferably ranges between about one-half and about one inch for a blade having a maximum width along its trailing edge of about 12 to 13 inches and a length of about 11 to 12 inches. The blade pivots and the direction of camber is reversible to function in both up and down strokes, as will be seen from the two extreme positions of the blade 11 shown in FIG. 3 in solid and dotted lines.

The swim fin of this invention also provides a blade having a pitch or angle in relation to the essentially vertical direction of fin motion to produce a propulsion vector. This is achieved by pivoting the blade up and down through a fixed angle. More importantly, the blade is pivoted aft of its leading edge 25, the pivot line being essentially parallel to leading edge 25 and located aft thereof at a distance equal to between about 20% and about 30% of the total length of the blade, with about 25% being preferred. As the blade pivots to produce pitch, the leading edge moves well upstream of the foot section of the fin to allow undisturbed and effectively streamlined water to flow on both sides of the blade. The maximum pivot angle $\phi$ permitted by the length of flexible connector 28 may range between about 15° and 30°, with about 25° being preferred.

Unlike the open passages previously provided in swim fin blades (see for example U.S. Pat. Nos. 3,082,422 and 3,183,529) the open passage 24 of the swim fin of this invention extends across the entire width of leading edge 25 of blade 11 and combined with the pivot placement, opens the passage to obtain the full effect of attaining flow on the low pressure side of the blade in both the up and down strokes.

Finally, because the construction of the swim fin of this invention reduces the resistance to vertical motion, the surface area of the blade may be, and preferably is, from about 20% to 30% larger than a conventional fin to obtain the same feeling of resistance. A predetermined feeling of resistance is desirable in obtaining a desired kicking rate; and therefore for any given kicking rate the increased blade area means a greater driving force for the swim fin. As an example of blade size the following dimensions may be given: width at leading edge about 7 inches, width at trailing edge about 12 to 13 inches and length about 11 to 12 inches.

It is therefore possible to characterize the swim fins of this invention as possessing at least three unique features in combination; namely, effective streamlining and reversible camber in the blade, limited pivoting of the blade wherein the pivot line is aft of the leading edge of the blade, and an unobstructed open passage between the trailing edge of the foot section and leading edge of the blade. In addition, it is also preferable that the blade surface be greater than conventional swim fins.

Figure 4:
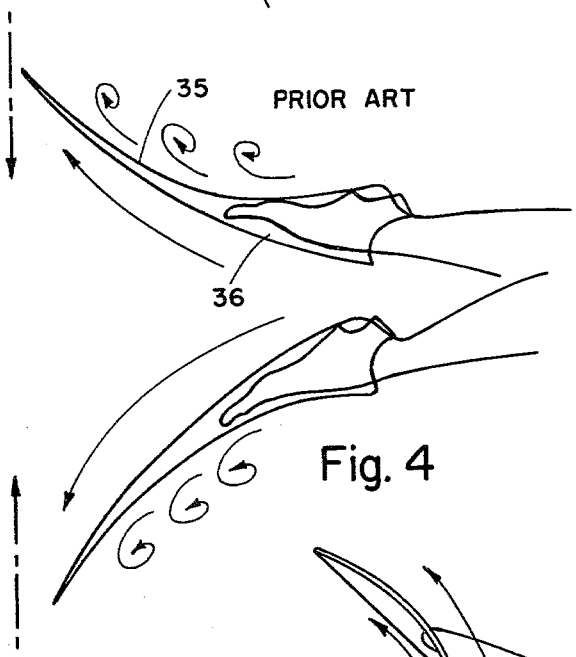
FIGS. 4–6 are diagrams illustrating the basic operation of swim fins constructed in accordance with two different commonly used prior art swim fin types and with this invention, respectively.
Figure 5:
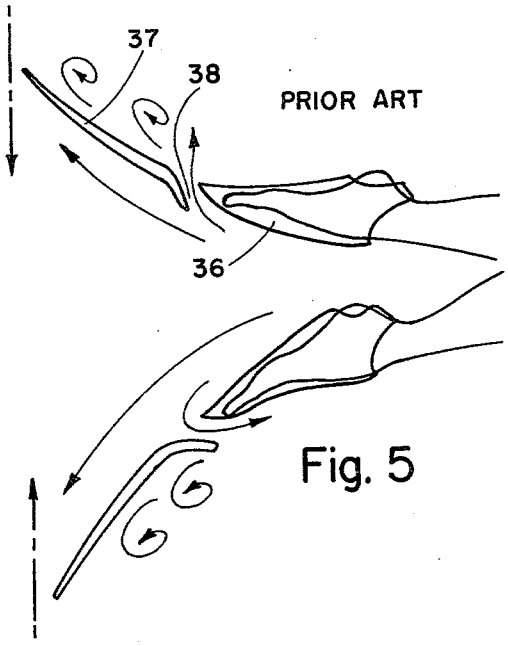
Figure 6:
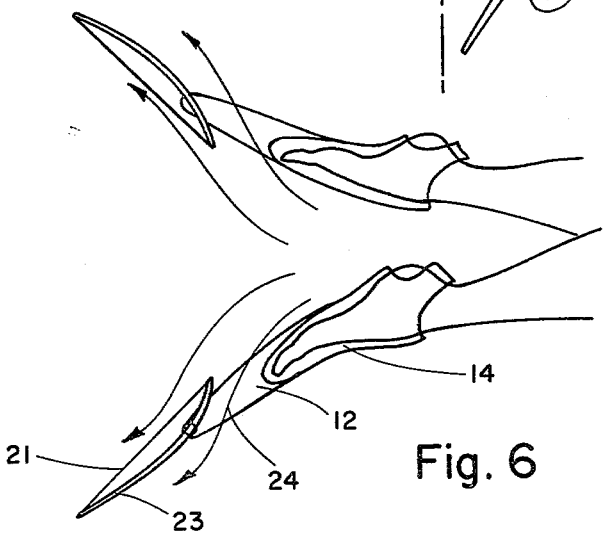

The advantages of the combination of these features may be set forth with reference to FIGS. 4–6, FIGS. 4 and 5 representing diagrammatically the two types of swim fins in current general use and FIG. 6 the swim fin of this invention.

The fins of FIG. 4 are of a relatively simple design in which the blade 35 is a continual extension of the foot section 36. It will be seen that some camber is produced in moving these fins vertically, but that, unlike the camber of the blades 11 of FIG. 6, the camber is exactly opposite from the desired direction. Hence, such fins as those shown in FIG. 1 do not possess an effective streamlining camber. This undesirable direction of camber is also encountered in the swim fins shown in FIG. 5 wherein the blades 37 have one or more open passages 38 cut through them.

Although the prior art (e.g., U.S. Pat. Nos. 2,343,468 and 3,082,442) discloses the pivoting of the blade relative to the foot section, the line of pivoting is at the leading edge of the blade, or its equivalent. In contrast, as will be seen in FIG. 6, by pivoting the blade aft of its leading edge and providing between the foot section and blade an unobstructed open passage, the leading edge of the blade moves well upstream of the foot section to permit the water to flow on both sides of the blade. This is not possible in the prior art swim fins. Moreover, in the conventional fins such as shown in FIGS. 4 and 5, blade pitch results from water pressure deflecting the flexible blade. Thus, the pitch must be proportional to the force of the kick. Therefore, whereas a gentle kick produces low pitch resulting in high effort and low drive in using conventional fins, the force of the kick does not determine the pitch of the blade of the fin of this invention. By deflecting freely to the optimum predetermined pitch, the efficiency of this new swim fin extends over the entire range of kicking force.

Finally, in the current swim fin design illustrated in FIG. 5, wherein one or more slots or passages 38 are provided in the blade which is rigidly molded to the foot section 36, it will be seen that the slots improve the function on the down stroke only, but are wrongly oriented to improve it on the upstroke. Moreover, since the blade of the type shown in FIG. 5 must possess a certain degree of stiffness to hold it in place relative to the foot section, the slots must, of necessity, be somewhat limited in size. This in turn means that there is an excessive pressure drop across the slots which detracts from the effect of the flow pattern sought.

Thus, the swim fins of this invention, by possessing the features delineated, achieve both an increase in drive and a decrease in effort giving rise to a marked increase in efficiency.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

I claim:

1. A swim fin, comprising in combination (a) a foot section adapted to receive a swimmer's foot and having a toe portion defining a trailing edge and a heel portion;

(b) oppositely disposed rigid pivot support members affixed to and extending aft of said trailing edge of said toe portion;

(c) a blade comprising a rigid frame defining a leading edge and opposite side edges and a flexible membrane having a small streamlining reversible camber mounted on said frame, said blade being pivotally mounted between said pivot support members along a pivot line essentially parallel to said leading edge of said blade and being located a distance equivalent to between about 20% and about 30% of the length of said blade aft of said leading edge of said blade and positioned to define an open passage extending across the distance between said pivot support members and between said leading edge of said blade and said trailing edge of said toe section; and (d) pivot limiting means arranged to limit the angle of blade pivot in either direction to no greater than about 30°.

2. A swim fin in accordance with claim 1 wherein said toe portion terminates in a flat extension member terminating in said trailing edge.

3. A swim fin in accordance with claim 2 wherein said pivot limiting means comprises flexible connectors between said leading edge of said blade and said flat extension member.

4. A swim fin in accordance with claim 1 wherein said camber is between about one-half and one inch.

5. A swim fin in accordance with claim 1 wherein said angle of blade pivot ranges between about 15° and about 30°.

6. A swim fin in accordance with claim 1 wherein said blade has the following dimensions: leading edge about 7 inches, trailing edge about 12 to 13 inches and length about 11 to 12 inches.

* * * * *